US008263882B2

(12) United States Patent
Laurent et al.

(10) Patent No.: US 8,263,882 B2
(45) Date of Patent: Sep. 11, 2012

(54) ELECTRICAL CONTROL DEVICE

(75) Inventors: Patrice Laurent, Viuz-en-Sallaz (FR); Laurent Mounier, Annemasse Cedex (FR)

(73) Assignee: DAV, Creteil (FR)

( * ) Notice: Subject to any disclaimer, the term of this patent is extended or adjusted under 35 U.S.C. 154(b) by 361 days.

(21) Appl. No.: 12/305,760

(22) PCT Filed: Jun. 16, 2007

(86) PCT No.: PCT/EP2007/055985

§ 371 (c)(1),
(2), (4) Date: Jul. 16, 2010

(87) PCT Pub. No.: WO2007/147791

PCT Pub. Date: Dec. 27, 2007

(65) Prior Publication Data

US 2011/0094864 A1 Apr. 28, 2011

(30) Foreign Application Priority Data

Jun. 20, 2006 (FR) ..... 06 05487

(51) Int. Cl.
*H01H 25/06* (2006.01)

(52) U.S. Cl. ..... 200/6 A

(58) Field of Classification Search ..... 74/471 XY, 74/553, 10 R; 200/4, 5 R, 6 A, 17 R, 18, 200/335; 341/20–22; 345/156, 157, 160, 345/161, 168, 169, 184
See application file for complete search history.

(56) References Cited

U.S. PATENT DOCUMENTS 4,763,100 A 8/1988 Wood
(Continued)

FOREIGN PATENT DOCUMENTS

EP 1 167 109 A2 1/2002
(Continued)

OTHER PUBLICATIONS

PCT Search Report of the ISA for PCT/EP2007/055985 dated Aug. 23, 2007.

(Continued)

*Primary Examiner* — Michael Friedhofer
(74) *Attorney, Agent, or Firm* — Daly, Crowley, Mofford & Durkee, LLP

(57) ABSTRACT

The subject of the present invention is an electric control or control-by-wire device comprising a control lever (11) that can be moved in a pivoting movement in a plane perpendicular to the lever in a position of rest, and that can be moved in a translational movement in a direction parallel to the lever in a position of rest, a rotary control member (13) that can be moved in a rotational movement and in a pivoting movement in a plane perpendicular to the lever in a position of rest, and an electrical circuit (15) for converting the various movements of the lever (11) and the rotary member (13) into control signals. The device comprises a lever base (19) that can move over a predefined travel parallel to the lever in a position of rest and which keeps the control lever fixed in terms of rotation and comprises a universal joint connection supporting the rotary control member in such a way as to connect it pivotally to the control lever (11).

32 Claims, 4 Drawing Sheets

U.S. PATENT DOCUMENTS

Figure 1:
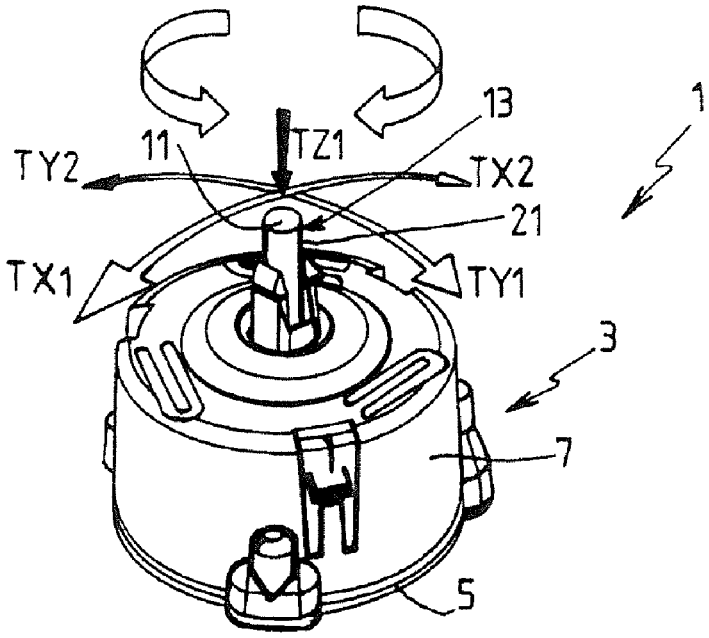

| | | | | |
|---|---|---|---|---|
| 5,952,628 | A * | 9/1999 | Sato et al. | 200/4 |
| 6,124,555 | A * | 9/2000 | Isikawa | 200/4 |
| 6,150,919 | A * | 11/2000 | Shimomura | 338/128 |
| 6,429,849 | B1 * | 8/2002 | An et al. | 345/161 |
| 7,227,090 | B2 * | 6/2007 | Kakuno et al. | 200/6 A |
| 8,039,767 | B2 * | 10/2011 | Saomoto | 200/6 A |
| 2004/0144628 | A1 * | 7/2004 | Sottong | 200/5 R |
| 2005/0284737 | A1 | 12/2005 | Shitanaka et al. | |

FOREIGN PATENT DOCUMENTS

| | | | |
|---|---|---|---|
| WO | WO 2005/027168 | A1 | 3/2005 |
| WO | WO 2007/147791 | A1 | 12/2007 |

OTHER PUBLICATIONS

PCT Written Opinion of the ISA for PCT/EP2007/055985 dated Aug. 23, 2007.

* cited by examiner

ELECTRICAL CONTROL DEVICE

CROSS REFERENCE TO RELATED APPLICATIONS

This application claims the benefit of International Patent Application PCT/EP2007/055985 filed Jun. 16, 2007, published in the French language as WO2007/147791, which application claims priority from French application number 0605487, filed Jun. 20, 2006.

The present invention relates to an electrical control device, in particular for an automobile, comprising a pivoting control lever and a rotary control member.

Currently, automobiles are increasingly being equipped with electronic assistance and convenience systems for the driver and his passengers.

Although some years ago it was rare, for example, for vehicles to be equipped with both an air-conditioning system and a navigation system, these systems are now becoming universally available and are accessible to a greater number of people and already offered together for certain basic versions.

Furthermore, the electronic systems are constantly being enhanced and offering more and more setting parameters.

Thus, the audio systems now almost all include different groups of loudspeakers, for which the left/right and front/rear balance can be adjusted.

The radio systems allow settings for rapid searches according to the program being broadcast or depending on whether or not the station broadcasts messages concerning the state of traffic in the region being traveled through.

For the air-conditioning systems, zonal air-conditioning parameter setting management has recently appeared.

All these systems require suitable control means that are ergonomic and easy to use.

To facilitate the controls in an automobile and to reduce the number of individual controls, multifunction controls associated with a display screen have emerged in the automobile sector.

These known controls typically take the form of a control lever or joystick that can be used to navigate in a menu displayed on the screen. A chosen function is selected, for example, by pressing on the gripping element of the control.

Furthermore, this joystick has been provided with a rotary control member which makes it possible, for example, to increase or reduce the volume of an audio system when this volume adjusting function has been chosen.

Thus, with a single multifunction control, it is possible to control a multitude of electronic systems and functions in an automobile. Because of the number of functions that can be controlled, this joystick is becoming a priority interface for the driver.

The result of this is that the free end of this joystick is becoming a position that is as important for the make of vehicle as, for example, the steering wheel.

Now, in the multifunction control devices known in the state of the art, when, for example, a logo is applied to this end, the logo rotates, which is not desirable.

The present invention aims to propose a solution relating to this problem.

Furthermore, the known joysticks are generally of a complex design, in particular electrical or electronic.

Another object of the present invention is to propose a device in which, in particular, the electrical/electronic part is simplified.

Independently of this problem, according to yet another objective of the present invention, the aim is to propose a multifunction control device with a control lever that can be lit reliably.

To this end, the subject of the invention is an electrical control device comprising:

- a control lever that can be moved in a pivoting movement in a plane perpendicular to the lever in its rest position, and that can be moved in translation in a direction parallel to the lever in its rest position,
- a rotary control member that can be moved in a rotation movement and in a pivoting movement in a plane perpendicular to the lever in its rest position, and
- an electric circuit for converting the various movements of the lever and of the rotary member into control signals, characterized in that it comprises a lever base that can move over a predefined travel in a direction parallel to the lever in its rest position and which keeps the control lever fixed in terms of rotation, and in that it comprises a universal joint connection supporting the rotary control member in such a way as to connect it pivotally to the control lever.

Figure 4:
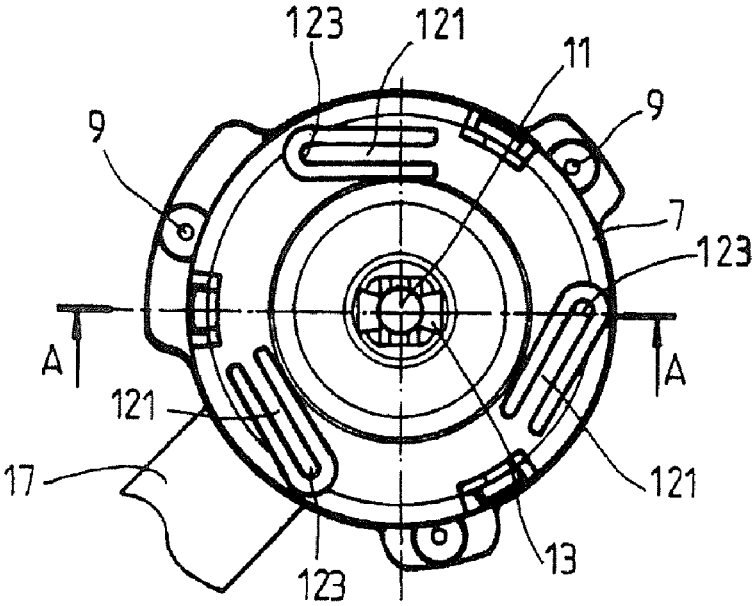
Figure 2:
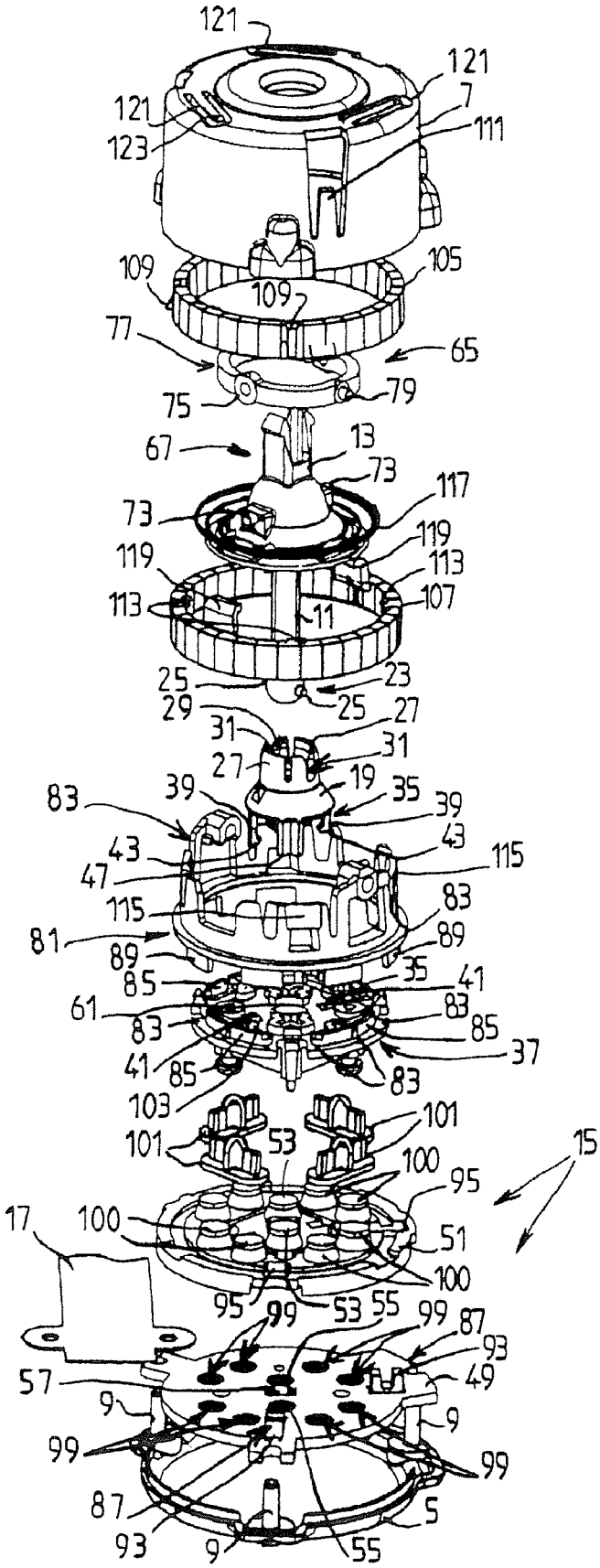
Figure 3:
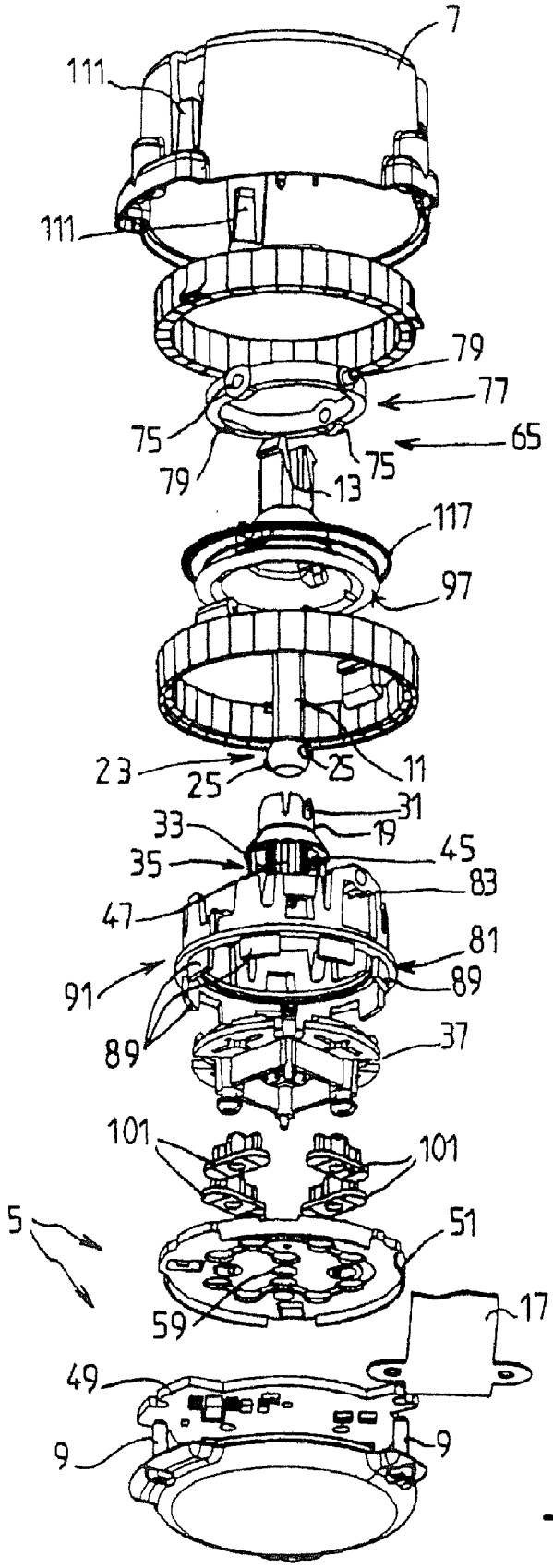
Figure 5:
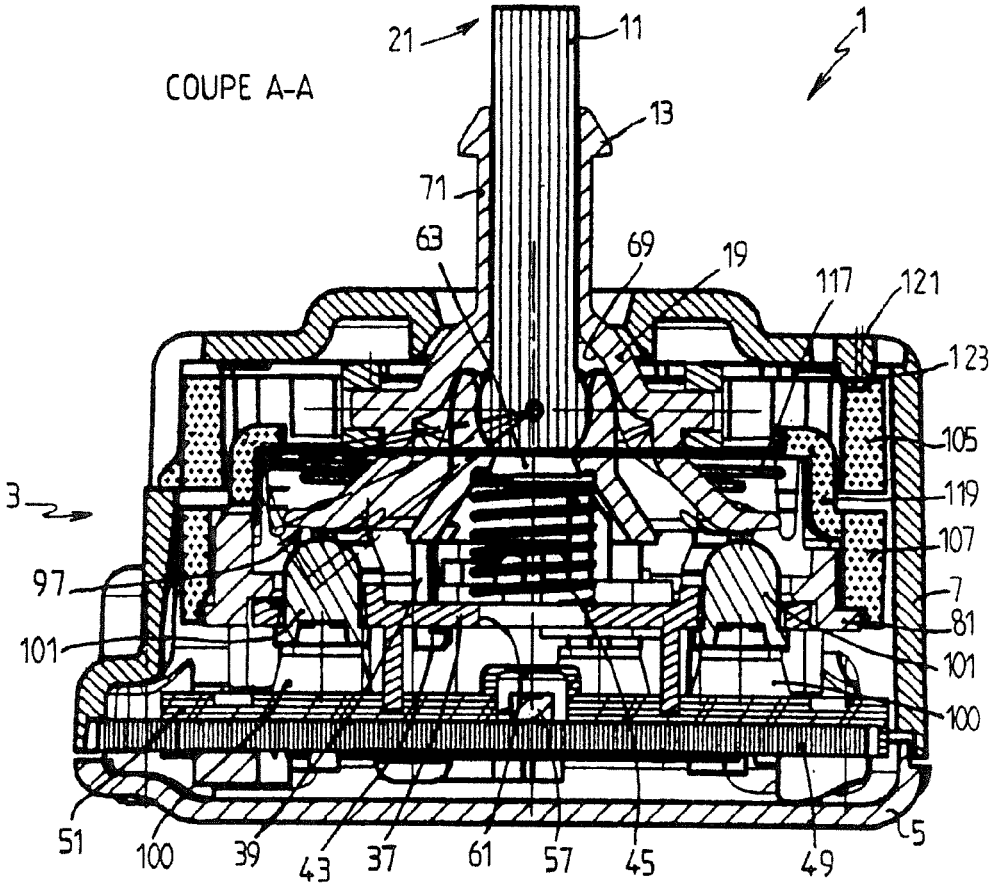

Other advantages and characteristics will become apparent from reading the description of the invention, and referring to the appended figures in which:

FIG. 1 is a perspective view of a device according to the invention in the assembled state, FIG. 2 is a first exploded view of the device according to the invention, FIG. 3 is a second exploded view of the device according to the invention, FIG. 4 is a top view of a device according to the invention, and FIG. 5 is a cross-sectional view through A-A of FIG. 4.

The electrical control device according to the invention is represented from different views in all the appended figures. In all the figures, the same elements are given the same references.

FIG. 1 is a perspective view of an electrical control device 1 according to the invention in the assembled state.

This device is fitted in a casing 3 consisting of a bottom 5 and a cover 7 assembled using screwing means 9 (see FIGS. 2 and 5).

It comprises a control lever 11 that can be moved in a pivoting movement in a plane perpendicular to the lever in its rest position.

In FIGS. 1 and 5, the lever 11 is shown in its rest position, that is, the lever 11 is essentially perpendicular to the plane defined by the bottom 5.

The pivoting movement of the lever 11 is represented in FIG. 1 by arrows TX1, TX2, TY1, TY2. It can therefore be seen that there is a first pivoting direction along an axis X and a second pivoting direction along an axis Y which is orthogonal to the first direction and is situated in the same plane as this first direction.

In the context of a multifunction system with display screen, these pivoting movements can, for example, be used to control pull-down menus.

Furthermore, the lever 11 can also be moved in translation in a direction parallel to the lever in its rest position. This direction is indicated in FIG. 1 by the arrow TZ1.

Generally, this movement is therefore, for a user, a press and is, for example, used to confirm the choice of a previously selected function.

The electrical control device according to the invention also comprises a rotary control member 13 that can be moved in a rotation movement about its axis.

Furthermore, the member 13 can also be moved to pivot by the same movements as the lever 11, that is, pivoting movements in a plane perpendicular to the lever in its rest position.

The various movements of the lever 11 and of the rotary member 13 are converted into control signals using an electric circuit 15 which will be described in more detail below and which is linked, for example, via an electrical connection loom 17 to a unit (not represented) for processing and using the control signals.

Hereinafter, the various components and elements of the device will be explained in relation to FIGS. 2 to 5.

As can be seen in FIGS. 2 and 3, the lever 11 is held fixed in rotation by a lever base 19. This base 11 can move over a predefined travel in a direction parallel to the lever in its rest position, that is, the direction TZ1 (see FIG. 1).

To this end, the control lever 11 has a free end 21 which can be configured, depending on the desired design, to be linked to a gripping member of the lever (not represented).

The other end 23 has a spherical shape with two diametrically opposing dog points 25. These dog points define a pivoting axis of the lever 11, or to be more precise, the pivoting axis for the movements according to the arrows TX1 and TX2.

To hold the lever 11 fixed in rotation, the lever base 19 comprises walls 27 forming dome-shaped parts and defining a spherical housing 29 for receiving the spherical end 23 of the lever. Diametrically opposing slots 31 are delimited by the walls 29 to receive the two dog points 25 so as to immobilize the lever in rotation while allowing a pivoting movement of the lever 11 by a sliding movement of the dog points in the slots. The duly defined pivoting movement is the movement according to the arrows TY1 and TY2 in FIG. 1.

According to a variant that is not represented, it is possible to provide additional dog points at the level of the spherical part of the lever 11 and additional slots at the level of the walls 27 to define additional pivoting directions while keeping the lever fixed in rotation.

Means 35 of guiding the base 19 in translation are provided to ensure a stable position of the base and thus of the lever 11.

These guidance means 35 of the base are borne on the one hand by the bottom face 33 of the base 19 and on the other hand by a support seat 37.

More specifically, the guidance means 35 of the base comprise at least two guide rods 39 borne by the bottom face 33 of the base 19 and cooperating with two corresponding openings 41 provided in the support seat.

Advantageously, the two rods 39 comprise, at their free ends, end-stops 43 for limiting the travel of movement of the lever 11 in a direction parallel to the lever in its rest position, that is, the direction TZ1 indicated in FIG. 1.

In order to define a clear rest position in this direction TZ1, the device comprises an elastic means 45 of repositioning to the rest position, such as a helical or tapered spring (see in particular FIGS. 1 and 5), pressing on the one hand on the bottom face 33 of the lever base and on the other hand on the support seat 37.

To transmit the action of a user, the base 19 also bears on its bottom face 33 at least one, preferably two, actuating pistons 47, each piston being able to actuate an associated switch borne by the electric circuit 15.

The electric circuit 15 comprises on the one hand a printed circuit card 49 and on the other hand a flexible membrane 51 positioned on the card 49, the membrane comprising for each piston 47 an elastic contacting mound 53 which works by pressing a piston onto the membrane to close an electric loop and deliver a control signal.

As can be seen in FIG. 2, the printed circuit card 49 has contacting lands 55 with a pattern, for example in coil-form, of two overlapping electrical tracks.

The mounds 53 include, inside, a metal or carbon pad which, when it comes into contact with an associated land 55, provides the electrical contact between the two tracks and thus produces the closure of an electric loop and therefore makes it possible to deliver a control signal.

In the context of the present invention, the problem of the lighting of the lever has also been addressed. This aspect of the invention can also be considered independently.

To this end, the lever 11 is made of a light-transmitting material and the printed circuit card 49 comprises a lighting means such as a light-emitting diode 57, centered relative to the axis defined by the lever 11 in its rest position.

The expression "light-transmitting material" should be understood to mean both a transparent material and a translucent material.

The membrane 51, the support seat 37 and the lever base 19 each include a central opening respectively bearing the reference numbers 59 (FIG. 3), 61 (FIGS. 2) and 63 (FIG. 5). These openings define a light passage (like a light chimney) so that the light emitted by the diode 57 passes through the light passage to be coupled via the spherical end 33 in the control lever 11 and lights the gripping end 21 of the lever.

This arrangement makes it possible to ensure an effective lighting without the need for complicated electrical or optical connections between the moving parts and the static parts.

Moreover, it can be seen that the spherical part 23 of the lever 11 serves as an optical lens facilitating the coupling of the light in the lever 11 by its wide aperture angle which minimizes the light losses.

Finally, the right-hand part of the lever 11 serves as a waveguide that contains the light inside the lever until it is expelled at the end 21.

Preferably, the lever is made of plastic material, in particular of polycarbonate. Obviously, any other optically transparent or translucent material can be used.

Having described in detail the structure and the operation of the lever, the description now focuses on the rotary control member 13.

This rotary member 13 is supported by a universal joint connection 65 so as to link the rotary member 13 pivotingwise to the control lever 11.

This has the effect that, when the lever pivots in the predefined directions TX1, TX2 and TY1 and TY2, the member 13 pivots together with the lever 11.

However, this link is only made in pivoting, but not in rotation, so that the member 13 can revolve freely whereas the lever 11 is fixed in rotation.

As can be clearly seen in FIGS. 2 and 3, the rotary control member 13 has an overall bell shape, the top 67 of which has a through opening 69 (FIG. 5) for the control lever 11.

Preferably, the bell-shaped member 13 is topped by a mechanical linkage means 71 with a gripping element of the rotary member (not represented). As an example, the means 71 can comprise snap-fitting, screwing or gluing means.

The bell-shaped part of the member 13 has, on opposite sides, two small spindles 73 (FIG. 2) designed to cooperate with two bearings 75 built into a universal joint ring 77.

This ring 77 itself has two swiveling axes 79 that are attached via a snap-fitting link to a part 81 called "carousel", for a reason that will become clear later in the description, and which has a circular shape.

To this end, the carousel 81 has two bearing support structures 83 able to receive the spindles 79 of the ring 77 by simple snap-fitting.

The part 81 is called "carousel" because it is formed free in rotation by the support seat 37. The carousel 81 can therefore revolve freely with the rotary member 13 and maintain the universal joint connection 65 with the rotary control member 13.

It can therefore easily be understood that a rotation movement applied to the member 13 is transmitted via the universal joint connection 65 to the carousel 81, independently of any pivoting movement that may be applied to the lever and therefore also to the member 13.

To limit the friction in rotation between the carousel 81 and the support seat 37, the support seat comprises, on its circular periphery, protuberances 83 called gadroons. This is in fact a dome part such that, at the level of each gadroon, there is only a one-off contact between the carousel 81 and the seat 37.

The support seat also comprises edges 85 for guiding and centering the carousel 81 in rotation.

For the rotary controls via the member 13, the device according to the invention is equipped with means 87 of detecting the rotation movement of the maintaining carousel 81.

Advantageously, these means 87 are optical means as represented in FIG. 2.

To this end, the means 87 of detecting rotation movement of the carousel 81 comprise screen portions 89 positioned regularly in a circle on the bottom face 91 of the carousel 81 and at least one, preferably two, light-barrier components 93 borne by the electric circuit and positioned so that the screens can interrupt a measuring light beam.

The way the screens scroll in front of the cells 93 creates square signals that can be used to measure the rotation of the carousel and therefore of the rotary member 13.

To detect the direction of rotation of the rotary control member, it proved best for the device to comprise at least two light-barrier components positioned offset from each other.

According to a variant that is not represented, magnetic means of detecting the rotation movement of the carousel are provided instead of optical means.

It should also be observed that, advantageously, these components are borne by the same printed circuit 49 as the contacting lands.

It should also be stated that the components 93 therefore take the form of a fork which passes through an associated opening 95 of the membrane 51 (see FIG. 2).

At this stage, all of the structure and the operation of the device has been explained for the TZ1 movements and rotation movements that are entirely disassociated, even relative to the pivoting movement that the lever 11 and the member 13 can describe.

There now follows an explanation of how the device translates a pivoting movement into control signals.

Even though the pivoting movement is defined by the control lever 11, it is transmitted via the rotary control member 13, in particular through the intermediary of the bottom periphery 97 of the bell that defines a control edge able to cooperate with at least one associated switch for detecting a pivoting movement borne by the electric circuit 49.

This circuit 49 comprises four double switches 99 positioned in pairs on opposite sides relative to the center of the circuit defined by the lever and that define perpendicular pivoting axes.

In operation, the control edge 97 cooperates with the double switches formed by contact lands 99 on the printed circuit 49 and contacting mounds 100, these switches making it possible to detect a pivoting movement through the intermediary of pistons 101. It can be seen that these switches are identical in their structure and their operation to the switches formed by the mounds 53 and the contacting lands 55.

The pistons 101 are received in cross-shaped openings 103 similar to the shapes provided in the seat 37 for the actuating pistons 47 of the lever base 19. The pistons are therefore guided in sliding by the support seat 37.

It is important to observe that, thanks to the particular mechanical structure of the device, the electric circuit part is broadly simplified.

In effect, all the electric circuit amounts to a single printed circuit card 49 with an associated flexible membrane 51.

There is no electrical component positioned on a moving part which avoids any electrical connection problems and increases the reliability and the life of the device.

Finally, this breakdown of the pivoting, pressing and rotation movements, in order to culminate either in the closure of a single switch concerning the pivoting and the pressing, or in a simple detection via an optical component for the rotation, all the components being positioned on the same printed circuit card, makes it possible to obtain a very competitive cost.

The use of double switches for both the detection of the pivoting movements TX1, TX2 and TY1, TY2 and pressing movements TZ1 makes it possible to better control the force to be imparted by the user. Furthermore, since there is a distribution of load between two single switches, in particular at the level of the flexible membrane, the mechanical stress of the membrane is reduced and the number of cycles that can be performed is increased while providing an operating field that is agreeable to the user and uniform.

In effect, for this type of electrical control device, the haptic sensations and their control and reproducibility are determining factors for a user. As has just been seen, for the pivoting movements and in the direction TZ1, it is the mounds 53 and 100 of the flexible membrane 51 that provide the haptic sensation.

For the haptic effect regarding the rotation movement, the device 1 also comprises means of indexing the rotary movement of the rotary control member 13.

According to the example described in relation to the figures and according to a preferred embodiment, these indexing means are produced in the form of magnetic indexing means.

As can be seen in FIGS. 1 and 2, the magnetic indexing means comprise a stator 105 and a rotor 107, each being produced in the form of a ring with north and south poles arranged alternately.

These rings are, for example, made of composite materials and obtained by a sintering or molding process.

The stator 105 is fixed in the cover 7 of the casing via a snap-fitting mechanism formed, for example, by fins 109 on the ring 105 and snap-fitting tabs 111 produced in a single piece with the cover 7.

Since the indexing effect is produced when the north and south poles of the rotor and of the stator scroll relative to each other, it could be understood that the distance between the rings 105 and 107 is a determining parameter for controlling the haptic effect.

To ensure that this haptic effect is always the same in the context of a production in large numbers, the cover 7 also comprises means of fitting the stator in a direction parallel to the control lever in its rest position.

Preferably, these fitting means comprise flexible tabs 121 produced in a single piece with the cover 7 and comprising ends 123 that press individually on the stator. This pressing at three points ensures that the stator is always indeed in place and that the distance between the stator 105 and the rotor 107 is always the same and identical around the entire circumference of the rings 105 and 107.

As for the rotor 107, the latter is fixed to the maintaining carousel 81, preferably also by snap-fitting means, that is, for example, protuberances 113 produced in a single piece with the ring 107 and chamfered flexible support pieces 115.

To keep the lever and therefore also the rotary member 13 in a stable rest position, the device also comprises a tapered spring 117 for maintaining in the rest position relative to a pivoting movement of the rotary member 13 and of the lever 11.

This spring 117 is pressed on the one hand on the top edge of the bell of the rotary member and on the other hand on retaining means borne by the rotor.

These retaining means are produced in a single piece with the rotor and preferably comprise fins 119.

It can therefore be understood from reading the above description that the device offers numerous benefits. Among these benefits, there is in particular a good mechanical disassociation of the various types of control movement, namely the pivoting, pressing or even rotation movements, which makes it possible to produce a clear and agreeable haptic effect for the user.

It should also be added that any electronic circuitry is concentrated at one and the same level on the immobile pieces without the need for complicated connection means.

Finally, a well thought-out solution concerning the lighting has also been developed and described.

The invention claimed is:

1. An electrical control device comprising:

a control lever having a central longitudinal axis, the control lever configured for pivoting movement in a plane perpendicular to the central longitudinal axis of the control lever in a rest position and configured for translational movement in a direction parallel to the central longitudinal axis of the control lever in its rest position;

a rotary control member configured for rotational movement and configured for pivoting movement in a plane perpendicular to the central longitudinal axis of the central longitudinal axis of the control lever in its rest position;

an electric circuit for converting movements of the control lever and the rotary member into control signals;

a lever base coupled to the control lever and configured to move over a predefined travel in a direction parallel to the central longitudinal axis of the control lever in its rest position and configured to keep the control lever fixed in terms of rotation; and a universal joint connection disposed to support the rotary control member in such a way as to pivotally couple it to the control lever.

2. The electrical control device as claimed in claim 1 wherein the control lever has a spherical end with two dog points that are diametrically opposed and define a pivoting axis of the control lever, and in that the lever base comprises walls forming dome-shaped parts and defining a spherical housing for receiving the spherical end of the control lever with the walls having slots provided therein, with the slots being diametrically opposed for receiving the two dog points so as to lock the control lever in terms of rotation while allowing a pivoting movement of the control lever by a sliding movement of the dog points in the slots.

3. The electrical control device as claimed in claim 2 further comprising means of guiding the base, said means of guiding coupled between a bottom face of the base and by a support seat.

4. The electrical control device as claimed in claim 3, wherein the base bears on its bottom face at least one, actuating piston able to actuate an associated switch coupled to the electric circuit.

5. The electrical control device as claimed in claim 4, wherein the electric circuit comprises a printed circuit card and a flexible membrane positioned on the printed circuit card and comprising for each piston an elastic contacting mound wherein the at least one piston cooperates with the flexible membrane to close an electric loop and deliver a control signal.

6. The electrical control device as claimed in claim 4, wherein the control lever is made of a light-transmitting material and the printed circuit card comprises a lighting means centered relative to the central longitudinal axis of the control lever in its rest position, and in that the membrane, the support seat and the lever base each include a central opening defining a light passage so that the light emitted by the lighting means passes through the light passage to be coupled in the control lever and to light a gripping end of the control lever.

7. The electrical control device as claimed in claim 6, wherein the control lever is made of plastic material.

8. The electrical control device as claimed in claim 3, wherein means of the guiding the base comprises at least two guide rods, said at least two guide rods coupled to the bottom face of the base and cooperating with two corresponding openings provided in the support seat.

9. The electrical control device as claimed in claim 8, wherein the two guide rods comprise, at their free ends, end-stops for limiting the travel of movement of the control lever in a direction parallel to the central longitudinal axis of the control lever in its rest position.

10. The electrical control device as claimed in claim 9, further comprising an elastic member for repositioning the control lever to the rest position.

11. The electrical control device as claimed in claim 1 wherein the rotary control member has an overall bell shape, the top of which has a through opening for the control lever and is topped by a mechanical linkage means with a gripping element of the rotary member, and of which the bottom periphery of the bell defines a control edge able to cooperate with at least one associated switch for detecting a pivoting movement of the electric circuit.

12. The electrical control device as claimed in claim 11 further comprising four double switches positioned in pairs on opposite sides relative to a center of the control lever and wherein the four double switches define perpendicular pivoting axes.

13. The electrical control device as claimed in claim 12 wherein the control edge cooperates with each double switch for detecting a pivoting movement through the intermediary of a piston guided by the support seat.

14. The electrical control device as claimed in claim 13 wherein the electric circuit comprises a printed circuit card and flexible membrane positioned on the printed circuit card and comprising at least one piston and, for each of the at least one pistons, two elastic contacting mounds which work by pressing the associated at least one piston onto the membrane to close an electric loop and deliver a control signal.

15. The electrical control device as claimed in claim 11 further comprising a carousel for maintaining the universal joint connection from the rotary control member, the carousel being able to be moved in rotation by pressing on a support seat.

16. The electrical control device as claimed in claim 15 wherein the support seat comprises, on its circular periphery, protuberances to limit the friction in rotation between the carousel and the support seat.

17. The electrical control device as claimed in claim 15, characterized in that the support seat also comprises edges for guiding and centering the carousel in rotation.

18. The electrical control device as claimed in claim 15 further comprising means of detecting rotation movement of the carousel.

19. The electrical control device as claimed in claim 18 wherein the means of detecting rotation movement of the carousel are optical means.

20. The electrical control device as claimed in claim 19 wherein the means of detecting rotation movement of the carousel comprise screen portions positioned regularly in a circle on a bottom face of the carousel and at least one light-barrier component coupled to the electric circuit and positioned so that at least part of the screen portions can interrupt a measuring light beam.

21. The electrical control device as claimed in claim 20, further comprising at least two light-barrier components for detecting the direction of rotation of the rotary control member.

22. The electrical control device as claimed in claim 18 wherein the means of detecting rotation movement of the carousel are magnetic means.

23. The electrical control device as claimed in claim 1, the electrical control device further comprising means of indexing the rotary movement of the rotary control member.

24. The electrical control device as claimed in claim 23 wherein the indexing means are magnetic indexing means.

25. The electrical control device as claimed in claim 14 wherein the magnetic indexing means comprise a stator and a rotor, each being produced in the form of a ring with north and south poles arranged alternately, and in that the rotor is coupled to the carousel.

26. The electrical control device as claimed in claim 25 further comprising a casing in two parts, a casing bottom and a cover and wherein the stator is held fixed by the cover.

27. The electrical control device as claimed in claim 26 wherein the cover of the casing also comprises means of fitting the stator in a direction parallel to the central longitudinal axis of the control lever in its rest position.

28. The electrical control device as claimed in claim 27 wherein the fitting means comprise flexible tabs produced in a single piece with the cover and comprising ends that press individually on the stator.

29. The electrical control device as claimed in claim 25, wherein the rotor is coupled to the carousel by snap-fitting means.

30. The electrical control device as claimed in claim 29 further comprising a tapered spring for maintaining in the rest position relative to a pivoting movement of the rotary member and of the control lever that is pressed on the top edge of the bell of the rotary control member and on retaining means coupled to the rotor.

31. The electrical control device as claimed in claim 30 wherein the retaining means are produced in a single piece with the rotor.

32. The electrical control device as claimed in claim 30 wherein the retaining means comprise fins.

* * * * *